US010415353B2

(12) United States Patent
Robey et al.

(10) Patent No.: US 10,415,353 B2
(45) Date of Patent: Sep. 17, 2019

(54) PERFORATING GUN RAPID FLUID INRUSH PREVENTION DEVICE

(71) Applicant: HALLIBURTON ENERGY SERVICES, INC., Houston, TX (US)

(72) Inventors: Richard Ellis Robey, Mansfield, TX (US); Allan Zhong, Plano, TX (US); Wesley Neil Ludwig, Fort Worth, TX (US); Christopher C. Hoelscher, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 366 days.

(21) Appl. No.: 15/028,895

(22) PCT Filed: May 6, 2015

(86) PCT No.: PCT/US2015/029511

§ 371 (c)(1),
(2) Date: Apr. 12, 2016

(87) PCT Pub. No.: WO2016/178680

PCT Pub. Date: Nov. 10, 2016

(65) Prior Publication Data

US 2018/0195372 A1 Jul. 12, 2018

(51) Int. Cl.

| | |
|---|---|
| ***E21B 43/117*** | (2006.01) |
| ***E21B 43/119*** | (2006.01) |
| ***E21B 43/116*** | (2006.01) |

(52) U.S. Cl.

CPC ..... *E21B 43/119* (2013.01); *E21B 43/116* (2013.01); *E21B 43/117* (2013.01)

(58) Field of Classification Search

CPC .. E21B 43/117; E21B 43/1195; E21B 43/119; E21B 43/11; E21B 43/263; F42B 1/02

See application file for complete search history.

(56) References Cited

U.S. PATENT DOCUMENTS

| | | | | |
|---|---|---|---|---|
| 2,486,133 A | | 10/1949 | Egger | |
| 2,818,808 A | * | 1/1958 | Dill | E21B 43/117 175/4.6 |
| 4,356,091 A | | 10/1982 | Niles | |
| 5,598,891 A | * | 2/1997 | Snider | E21B 27/02 166/297 |

(Continued)

OTHER PUBLICATIONS

Baxter, Dennis et al., Perforating—When Failure is the Objective, Oilfield Review, Autumn 2009, 21, No. 3, Schlumberger, Washington, DC.

(Continued)

*Primary Examiner* — Kipp C Wallace
(74) *Attorney, Agent, or Firm* — Polsinelli PC

(57) ABSTRACT

A perforating gun apparatus for use in a wellbore comprising at least one explosive component and a disintegration-resistant porous material. The disintegration-resistant porous material minimizes fluid shock propagation from a perforated reservoir resulting from the inrush of fluid and debris. A system and method of minimizing fluid shock propagation effects in a perforating gun apparatus using a disintegration-resistant porous material to attenuate fluid pressure waves during a perforation operation in a subterranean well.

17 Claims, 9 Drawing Sheets

(56) References Cited

U.S. PATENT DOCUMENTS

| | | | | |
|---|---|---|---|---|
| 5,960,894 | A | 10/1999 | Lilly et al. | |
| 6,554,081 | B1 | 4/2003 | Brooks et al. | |
| 6,732,798 | B2 | 5/2004 | Johnson et al. | |
| 7,121,340 | B2 | 10/2006 | Grove et al. | |
| 7,246,659 | B2 | 7/2007 | Fripp et al. | |
| 7,451,819 | B2 | 11/2008 | Chang et al. | |
| 7,571,768 | B2 | 8/2009 | Cuthill | |
| 7,861,784 | B2 * | 1/2011 | Burleson | E21B 43/1195 166/297 |
| 7,878,246 | B2 | 2/2011 | Samueal et al. | |
| 7,980,308 | B2 * | 7/2011 | Myers, Jr. | E21B 43/1195 166/297 |
| 8,286,697 | B2 | 10/2012 | Evans et al. | |
| 8,286,706 | B2 | 10/2012 | McCann et al. | |
| 8,794,335 | B2 | 8/2014 | Fadul et al. | |
| 2003/0089498 | A1 | 5/2003 | Johnson et al. | |
| 2003/0150646 | A1 | 8/2003 | Brooks et al. | |
| 2006/0102352 | A1 | 5/2006 | Walker | |
| 2007/0095572 | A1 | 5/2007 | Harvey et al. | |
| 2010/0307327 | A1 * | 12/2010 | Gettle | F41H 5/0442 89/36.02 |
| 2011/0011587 | A1 | 1/2011 | Al Busaidy | |
| 2012/0181026 | A1 | 7/2012 | Le et al. | |

OTHER PUBLICATIONS

Katti, Atul et al.; Chemical, Physical, and Mechanical Characterization of Isocyanate Cross-linked Amine-Modified Silica Aerogels; Chem. Mater, 2006, vol. 18, No. 2, American Chemical Society, US.

H. Luo et al., The compressive behavior of isocyanate-crosslinked silica aerogel at high strain rates, Mech Time—Depend Mater, 2006, 10:83-111, Springer Science + Business Media B.V., US.

Jung, A. et al., New hybrid foam materials for impact protection, International Journal of Impact Engineering 64, 2014, pp. 30-38, Elsevier Ltd.

Zhong, Justin, Optimization of Crosslinked Aerogel Nanostructures for Energy Absorption, T.C. Jasper High School, 2010.

International Search Report and Written Opinion dated Jan. 7, 2016 in International Application No. PCT/US2015/029511.

* cited by examiner

PERFORATING GUN RAPID FLUID INRUSH PREVENTION DEVICE

CROSS-REFERENCE TO RELATED APPLICATIONS

This application is a national stage entry of PCT/US2015/029511 filed May. 6, 2015, said application is expressly incorporated herein in its entirety.

FIELD

The present technology pertains to perforating a cased wellbore that traverses a subterranean formation, and more specifically pertains to a perforating gun apparatus that is operated to perforate the casing and to attenuate fluid shock propagation produced by well perforating.

BACKGROUND

Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. Thereafter, a perforation tool assembly may be run into the casing, and one or more perforation guns in the perforation tool assembly may be activated and/or fired to perforate the casing and/or the formation to promote production of hydrocarbons from selected formations. Perforation guns may comprise one or more explosive charges that may be selectively activated, the detonation of the explosive charges desirably piercing the casing and penetrating at least partly into the formation proximate to the wellbore.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
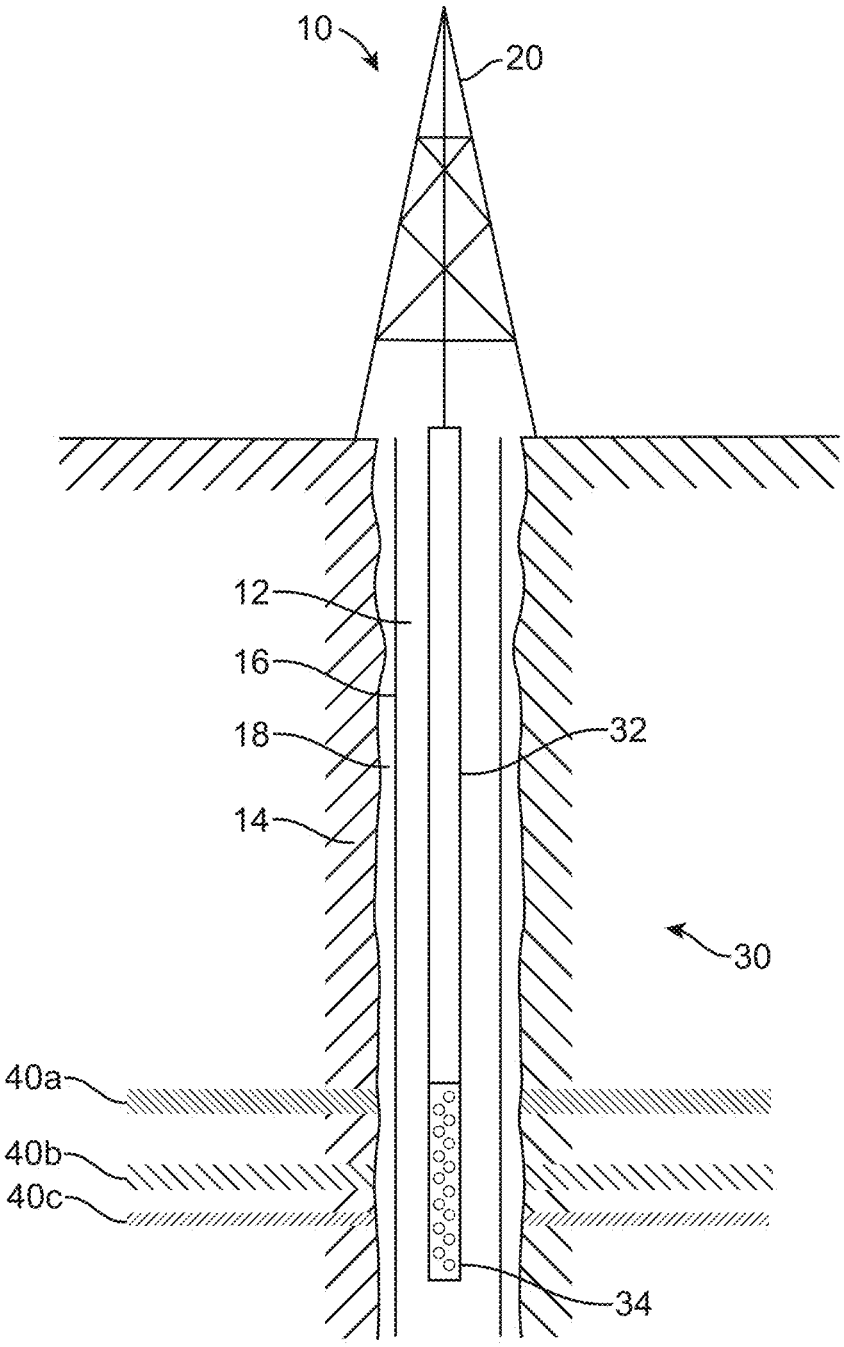
FIG. 1 is a schematic diagram of a wellbore and workstring according to an embodiment of the disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed apparatus, methods, and systems may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone," "pay zone," or "production zone" as used herein refers to separate parts of the wellbore designated for treatment or production and may refer to an entire hydrocarbon formation or separate portions of a single formation such as horizontally and/or vertically spaced portions of the same formation. The various characteristics described in more detail below, will be readily apparent to those skilled in the art with the aid of this disclosure upon reading the following detailed description, and by referring to the accompanying drawings.

Description

Upon activation of a perforating gun, the venting of pressurized fluids from the formation released by perforating may create rapid fluid inflow into the perforating gun body. The fluid velocity may be near the speed of sound and translates into a very high fluid inertia due to the high density of completion fluids and/or other fluid present in the wellbore or formation. The inrush of fluids and debris can have detrimental effects on perforating guns, gun strings, and other downhole tools. Reduction of that rapid fluid inrush may reduce the failure rate of perforating guns and other downhole tools. Attenuation of rapid fluid inrush is even more useful whenever a partially loaded perforating gun is used since the large volume of trapped air, created by the absence of one or more explosive components, allows the inrushing fluid to gain momentum creating larger pressure spikes that can result in rupture of the perforating gun body or other components.

The present disclosure describes a perforating gun apparatus for use in a wellbore comprising at least one explosive component and a disintegration-resistant porous material capable of minimizing fluid shock propagation effects from the inrush of fluid and debris during a perforation operation in a subterranean well.

FIG. 1 illustrates a schematic view of an embodiment of a wellbore operating environment in which a perforating gun apparatus may be deployed. As depicted, the operating environment 10 comprises a servicing rig 20 that extends over and around a wellbore 12 that penetrates a subterranean formation 14 for the purpose of recovering hydrocarbons from a first production zone 40*a*, a second production zone 40*b*, and/or a third production zone 40*c*, collectively the production zones "40". The wellbore 12 may be drilled into the subterranean formation 14 using any suitable drilling technique. While shown as extending vertically from the surface in FIG. 1, the wellbore 12 may also be deviated, horizontal, and/or curved over at least some portions of the wellbore 12. For example, the wellbore 12, or a lateral wellbore drilled off of the wellbore 12, may deviate and remain within one of the production zones 40. The wellbore 12 may be cased, open hole, contain tubing, and may generally be made up of a hole in the ground having a variety of shapes and/or geometries as is known to those of skill in the art. In the illustrated embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but a different structure may also support the workstring 30. The servicing rig 20 may also comprise a derrick with a rig floor through which the workstring 30 extends downward from the servicing rig 20 into the wellbore 12. In some cases, such as in an off-shore location, the servicing rig 20 may be supported by piers extending downwards to a seabed. Alternatively, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, another servicing vehicle, a coiled tubing unit and/or other apparatus.

As illustrated, the workstring 30 may include a conveyance 32 and a perforating gun apparatus 34. The conveyance 32 may be any of a string of jointed pipes, a slickline, a coiled tubing, and a wireline. In other examples, the workstring 30 may further contain one or more downhole tools (not shown in FIG. 1), for example above the perforating gun apparatus 34. The workstring 30 may have one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to position the perforating gun apparatus 34 to perforate the casing 16 and penetrate one or more of the production zones 40.

Many components of the wellbore operating environment 10 can be assembled in the field, including the portions of the perforating gun. The perforating gun apparatus may be tubing conveyed or wireline conveyed. In preparing a perforating gun, individual charge tubes are inserted into gun bodies of the perforating gun apparatus by, for example, a gun loader. Each charge tube is assembled, for example by adding the charges, and then the charge tube is inserted into the gun body and aligned with the scallops of the gun body. In some cases, a perforating gun may be loaded or assembled immediately before conveying the gun into the wellbore.

Figure 2:
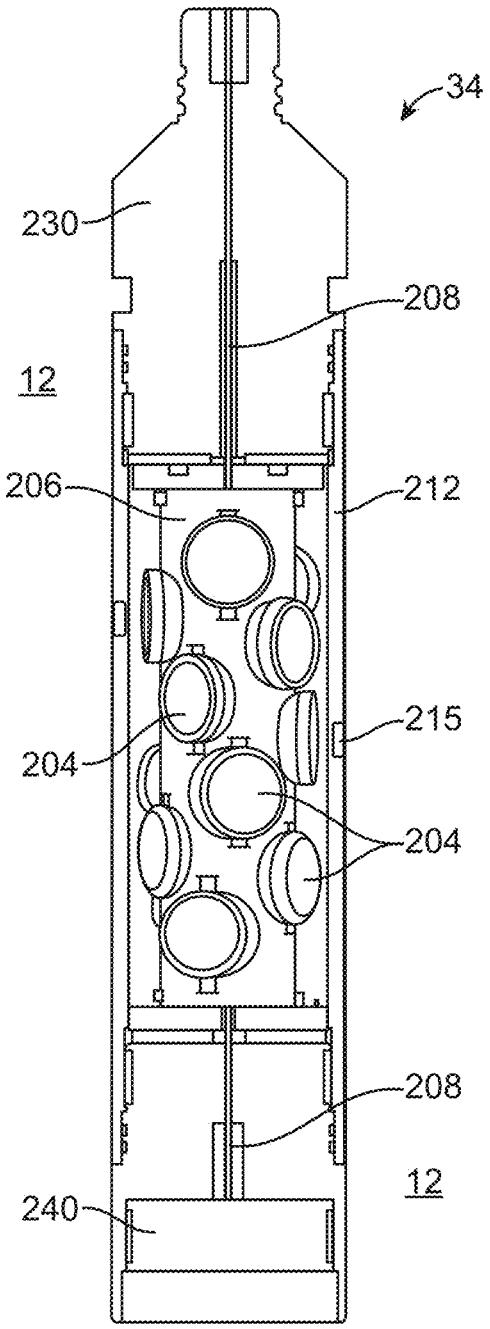
FIG. 2 is a cut-away view of an embodiment of a perforating gun apparatus.

FIG. 2 illustrates a cut-away view of an embodiment of the perforating gun apparatus 34 that may be lowered into the wellbore 12 during a perforation operation. The perforating gun apparatus 34 may be of conventional design which may comprise a plurality of explosive devices 204 (e.g., perforating charges or shaped charges) disposed within a gun body 212 that are detonated in order to perforate the casing (e.g., casing 16 of FIG. 1). The perforating gun apparatus 34 may also include elements such as a charge holder 206, a detonation cord 208, boosters, and/or other types of detonation transfer components. The detonation cord 208 may couple to each perforating charge 204. The perforating gun apparatus 34 may be coupled to additional perforating guns or the workstring via the upper end portion 230 or lower end portion 240. The upper and lower end portions 230, 240 can include various connecting pieces, such as tandems, connectors, various male or female threaded units, or other connecting units, along with any associated seals.

The perforating gun apparatus 34 may include at least one perforating charge 204 disposed within the gun body 212. The gun body 212 may have a plurality of recesses or "scallops" 215 on an exterior surface of the gun body 212. The scallops 215 provide a path for the perforating charge material to more easily blast through after detonation of charges (not shown in FIG. 2). Scallops 215 optimize charge performance and prevent casing damage from perforating exithole burrs. A perforating charge generally has a steel outer casing that contains an explosive powder or similar material that is activated and pierces through the scallops 215 of the gun body 212. The gun body 212 can be formed of any material, such as plastics, metals, ceramics, foams, and other materials within ordinary skill can be employed.

The perforating charge may be arranged in various configurations, for example, a helical configuration. Any other configuration or pattern of charges 204 as is well known in the art may also be used. The perforating charge may be any type of perforation charge that is known in the art. The perforating charge 204 may be a shaped charge that is designed to focus a resulting explosive jet in a predetermined direction. The focused jet may include a cohesive jet and/or a projectile. Each perforating charge 204 may have a metal liner surrounded on the concave side by an explosive material, and a charge casing may surround the explosive material and liner.

While the perforating gun apparatus 34 is shown in FIG. 2 as one perforating gun apparatus, it is to be understood that the perforating gun apparatus 34 may consist of one, two, or more perforating gun apparatuses 34 coupled together with any number of perforating charges per perforating gun apparatus 34 as long as the finally constructed perforating gun apparatus 34 can be fitted into a wellbore. The perforating gun apparatus 34 may be deployed on coiled tubing, wireline, slickline, or jointed pipe.

In some examples, the perforating gun apparatus 34 may include any number of additional components (e.g., end caps, blank sections, spacers, transfer subs, etc.), which may be assembled in a string.

Detonation of the perforating charges 204 pierces the casing and allows fluids to enter the wellbore from the production zone. The inrush of fluids into the wellbore may be enhanced as a result of conducting perforation operations during under-balanced or dynamic under-balanced operating conditions so that the surge may carry debris away from the reservoir in order to avoid skin damage to the production zone.

After the detonation of the perforation charges 204, empty charge cavities are created in the perforating gun apparatus 34 where the fired charges were originally located. Fluids from the wellbore may rush into the perforating gun apparatus 34 with great velocity as the perforating gun apparatus 34 acts as a pressure sink. The inflowing fluid may enter the gun body 212 at close to the speed of sound. Additionally, the high density of completion fluids produces very high fluid inertia. The column of compressible air remaining in the perforating gun apparatus 34 following detonation gives the completion fluid additional distance to accelerate before encountering the hard stop at the terminal ends of the perforating gun apparatus 34. The resultant pressure spike can damage the perforating gun apparatus 34 and other downhole tools during perforation operations. In the case of the perforation gun apparatus 34 shown in FIG. 2, the pressure spike may be greatest at the upper end portions 230 or lower end portions 240 where the inrushing fluids encounter the hard stop at the terminal ends of the perforating gun apparatus 34.

Figure 3:
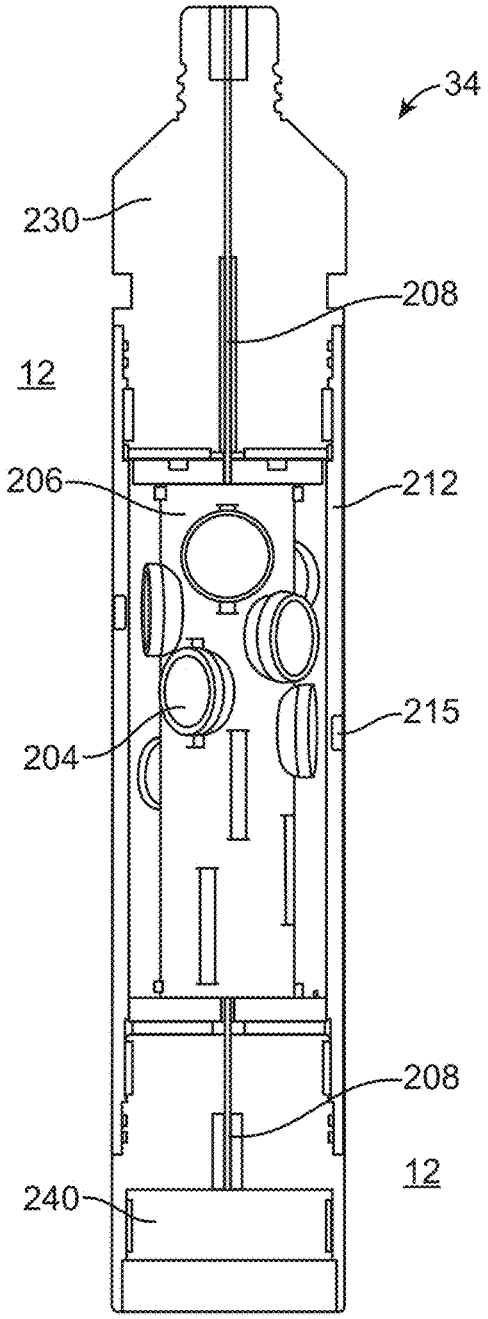
FIG. 3 is a cut-away view of an embodiment of a partially-loaded perforating gun apparatus.

FIG. 3 illustrates a cut-away view of an embodiment of the perforating gun apparatus 34 where the gun is partially-loaded with explosive devices 204. A perforating gun apparatus 34 may be partially-loaded when the full set of perforating charges 204 of the perforating gun apparatus 34 does not exactly align with the targeted production zone. In order to avoid perforation that is not coincident with the production zone, the perforation gun apparatus 34 may be partially-loaded so that perforation only occurs along those portions of the gun body 212 that are aligned with the production zone. The partially-loaded perforation gun apparatus 34 may be assembled in the field by either removing the unnecessary explosive devices from the perforating gun apparatus 34 or by adding only the necessary explosive devices to the perforation gun apparatus 34. In either case, partially-loaded perforation guns are especially prone to failure during perforation operations because the large volume of trapped air, created by the absence of one or more explosive components, allows the inrushing fluid to gain momentum resulting in larger pressure spikes. Additionally, the partially-loaded perforating gun apparatus 34 often experiences uneven fluid inrush following detonation resulting in even greater pressure spikes.

Figure 4:
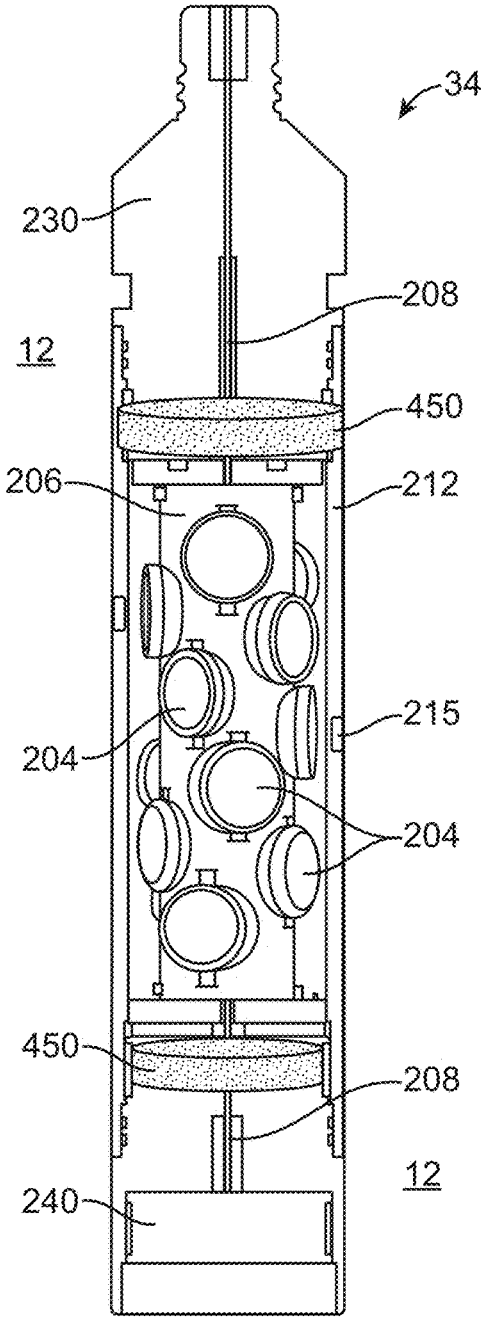
FIG. 4 is a cut-away view of an embodiment of a perforating gun apparatus comprising disintegration-resistant porous material placed near the upper end portion and lower end portion of the perforating gun.

FIG. 4 illustrates a cut-away view of an embodiment of the perforating gun apparatus 34 configured to attenuate the rapid fluid inrush produced by well perforation, having a disintegration-resistant porous material 450 disposed in the gun body 212. The disintegration-resistant porous material 450 gradually decelerates the inrushing fluid column rather than instantaneously, thereby minimizing fluid shock propagation from a perforated reservoir. The disintegration-resistant porous material 450 can act to disrupt the flow path of the fluid, thereby decreasing the energy of the fluid and preventing the fluid from further accelerating. Disintegration-resistant porous materials respond to elevated fluid pressures without substantial disintegration, thereby minimizing fluid shock propagation and minimizing reservoir-fouling debris.

Various types of disintegration-resistant porous material may be provided to attenuate the rapid fluid inrush produced by well perforation. The disintegration-resistant porous material typically must be selected and positioned such that it will survive a detonation of the perforation gun and stay in place during fluid in-rush after detonation. The disintegration-resistant porous material may be at least partially covered by a shroud to protect the material from the energetic event (detonation).

According to this disclosure, the disintegration-resistant porous material may allow fluid communication but retard fluid flow. As disclose herein, the disintegration-resistant porous material does not significantly change the free air volume within the gun due to its high volume fraction of pores, at least in some cases.

In an illustrated embodiment, the disintegration-resistant porous material 450 is positioned within the gun body near the upper end portions 230 or lower end portions 240, as shown in FIG. 4, in order to attenuate a pressure spike associated with fluid acceleration towards the terminal portions of the gun body 212.

Although in the illustrated embodiment, the disintegration-resistant porous material is shown near upper end portions or lower end portions, the disintegration-resistant porous material may be positioned in the gun body 212 wherever the greatest magnitude pressure spike is determined to exist.

The free volume within the gun body may also be substantially filled with the disintegration-resistant porous material.

Figure 5:
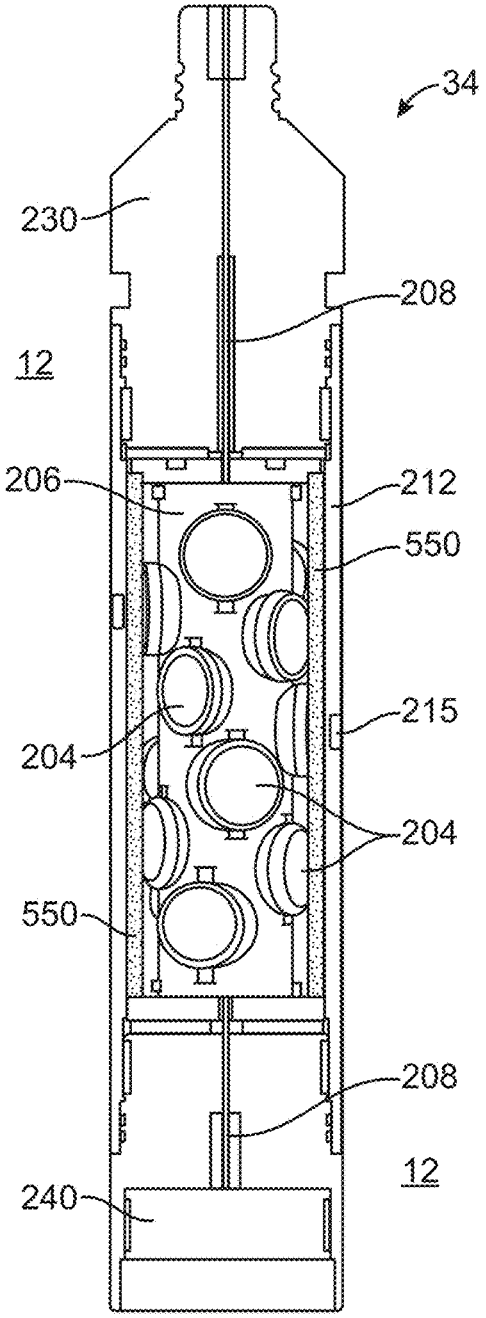
FIG. 5 is a cut-away view of an embodiment of a perforating gun apparatus comprising a cylinder of disintegration-resistant porous material surrounding the explosive devices of the perforating gun.

FIG. 5 illustrates a cut-away view of an embodiment of the perforating gun apparatus 34 configured to attenuate rapid fluid inrush, having a cylinder of disintegration-resistant porous material 550 surrounding the explosive devices 204 within the gun body 212.

Figure 6:
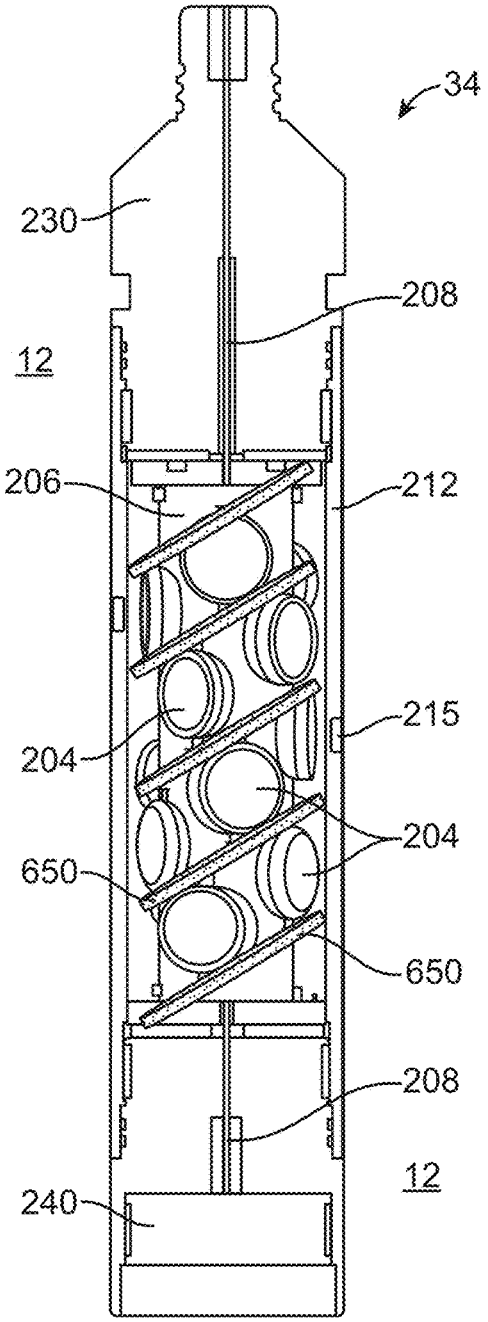
FIG. 6 is a cut-away view of an embodiment of a perforating gun apparatus comprising disintegration-resistant porous material positioned between the explosive devices of the perforating gun.

FIG. 6 illustrates a cut-away view of an embodiment of the perforating gun apparatus 34 configured to attenuate rapid fluid inrush, having pucks or discs of disintegration-resistant porous material 650 inserted between the explosive devices 204 within the gun body 212.

According to the present disclosure, the disintegration-resistant porous material may also be disposed in the gun body in the form of rings or baffles.

As disclosed herein, the charge holder 206 may at least in part be constructed from disintegration-resistant porous material.

Figure 7:
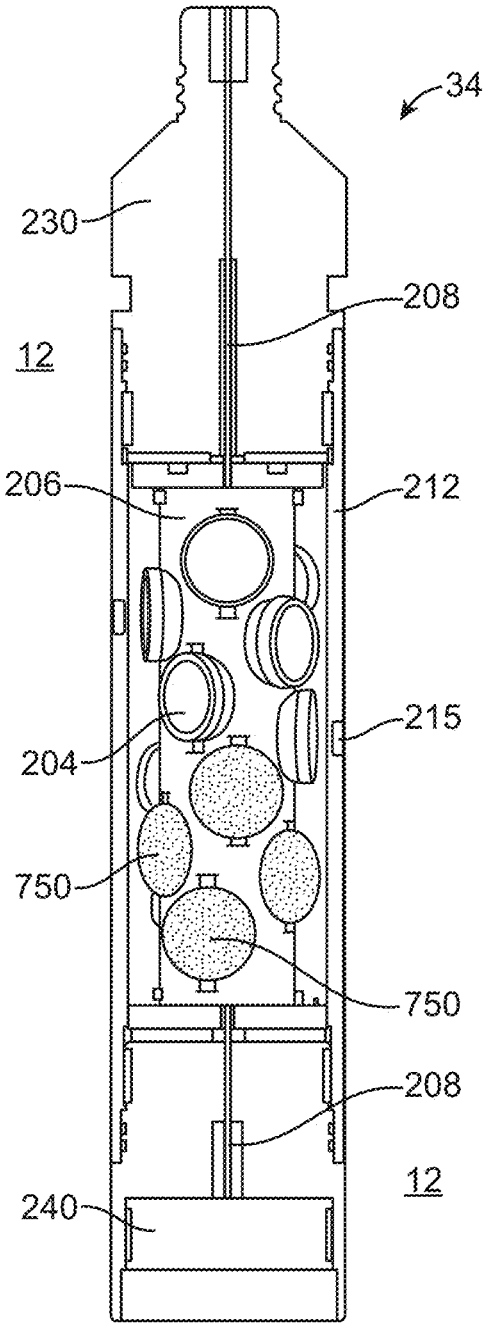
FIG. 7 is a cut-away view of an embodiment of a partially-loaded perforating gun apparatus comprising disintegration-resistant porous material positioned in place of the removed explosive devices.

FIG. 7 illustrates a cut-away view of an embodiment of the a partially-loaded gun apparatus 34 configured to attenuate rapid fluid inrush, having disintegration-resistant porous material 750 attached to the charge holder 206 in place of the absent explosive devices 204.

A partially-loaded gun apparatus 34 may also be configured to attenuate rapid fluid inrush according to the embodiments shown in FIGS. 4-6.

As disclosed herein, the free volume within the partially-loaded perforating gun apparatus 34 may also be substantially filled with disintegration-resistant porous material. Alternatively, the disintegration-resistant porous material may be positioned within the partially-loaded perforating gun apparatus 34 wherever the greatest magnitude pressure spike is determined to exist.

The partially-loaded perforating gun apparatus 34 may also have a charge holder 206 that is at least in part constructed from disintegration-resistant porous material.

The partially-loaded perforating gun apparatus 34 may also include disintegration-resistant porous material that is disposed in the gun body 212 in the form of rings or baffles.

The partially-loaded perforating gun apparatus 34 may also include disintegration-resistant porous material that is disposed in the gun body 212 in the form of a cylinder.

The partially-loaded perforating gun apparatus 34 may also include disintegration-resistant porous material that is disposed in the gun body 212 in the form of pucks or discs inserted between the explosive devices 204 within the gun body 212.

As disclosed herein, a method of attenuating the effects of fluid inrush produced by perforating a subterranean well or wellbore may include a disintegration-resistant porous material. The method may include placing a disintegration-resistant porous material into the body of at least one perforation gun, wherein the disintegration-resistant porous material is capable of attenuating the effects of fluid inrush produced by perforating a subterranean well. The method may further include running the at least one perforation gun into the wellbore to a perforation depth, and detonating at least one explosive device disposed within the body of the at least one perforation gun.

As disclosed herein, a perforating gun system may utilize at least one explosive device disposed within a gun body and a disintegration-resistant porous material disposed in the gun body, wherein the disintegration-resistant porous material attenuates the inrush of fluid produced by detonation of the explosive device.

The various embodiments in this disclosure pertaining to the apparatus, method and system for attenuating the effects of fluid inrush produced by perforating a subterranean well are operable in static underbalanced, dynamic underbalanced, and/or overbalanced wellbore conditions. As disclosed herein, the apparatus, method and/or system for attenuating the effects of fluid inrush produced by perforating a subterranean well does not significantly cause or enhance dynamic underbalancing, at least in some cases.

The disintegration-resistant porous material described herein may be capable of attenuating the effects of fluid inrush produced by perforating a subterranean well. The disintegration-resistant porous material may be metallic, non-metallic, or metalloid.

The disintegration-resistant porous material may be a foamed metal or a compressed wire mesh.

Figure 8:
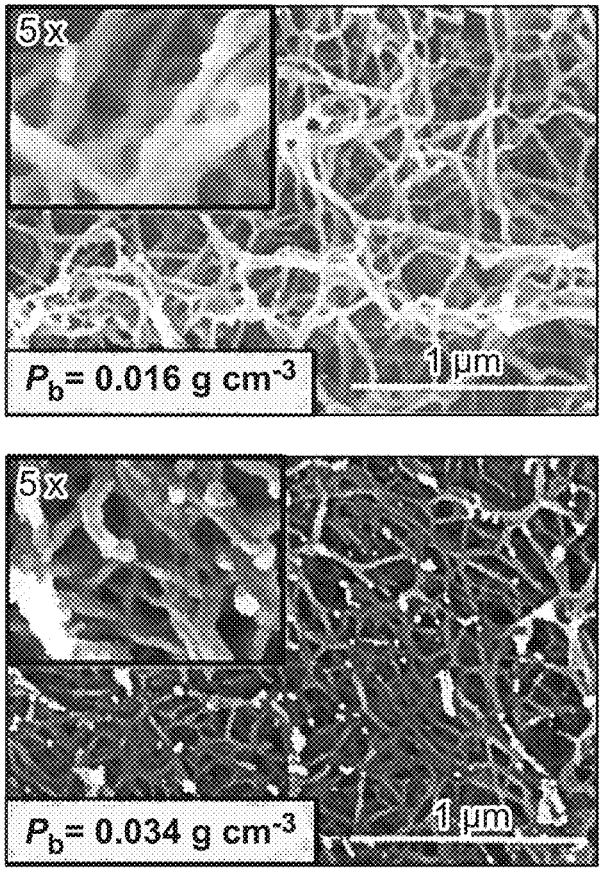
FIG. 8 contains two SEM micrographs showing the internal porous microstructure of aerogels of different densities.

The disintegration-resistant porous material may be an aerogel. FIG. 8 illustrates the porous open cell nature of aerogels. Aerogels also possess high mechanical shock attenuating properties and a low specific density resulting in the material not significantly reducing the free air volume during explosive detonation, which can cause high burst pressures.

The disintegration-resistant porous material may be a cross-linked aerogel or similar metallic foam. Aerogels are an exceptionally light solid material characterized by a porous fractal structure. While the applications for standard aerogels are often limited by concerns of fragility, this may be alleviated by coating the internal nanostructure of aerogels with a thin polymer layer forming a cross-linked aerogel. The polymer cross-linked aerogel is both lightweight and mechanically strong. Cross-linked aerogels are highly porous at the nanoscale level (Mech. Time-Depend. Mater. 10, 83-111(2006)) and have superb specific energy absorption (i.e. energy absorption per unit mass) capacity. Upon impact, cross-linked aerogels absorb energy by pore space collapse, thereby dissipating energy.

The disintegration-resistant porous material may be a cross-linked silica aerogel with polyureas derived by isocyanate (Chem. Mater. 18, 285-296 (2006)). Isocyanate cross-linked amine-modified silica aerogels are mechanically strong lightweight porous composite materials obtained by encapsulating the skeletal framework of amine-modified silica aerogels with polyurea.

The cross-linked silica aerogels may be prepared using the sol-gel process and cross-linked using Desmodur N3200 (urea monomer), or techniques known in the art for the preparation of cross-linked silica aerogels.

The cross-linked aerogel may be a polyimide aerogel.

The cross-linked aerogel can be a carbide aerogel, metal aerogel, or metalloid aerogel. The cross-linked aerogel may also be a silicon carbide aerogel, iron carbide aerogel, vanadium carbide aerogel, tin carbide aerogel, boron carbide aerogel, or nickel carbide aerogel.

Alternatively, the cross-linked aerogel may be a metal oxide aerogel. The cross-linked aerogel may also be an iron oxide aerogel, nickel oxide aerogel, tin oxide aerogel, or vanadium oxide aerogel.

The cross-linked aerogel may also be a chalcogenide aerogel, nitride aerogel, or a phosphide aerogel.

The cross-linking agent used to conformally coat the porous three-dimensional precursor material to form the cross-linked aerogel may be, in at least some instances, isocyanate, diisocyanate, polyisocyanate, polyimides, or triphenylmethane-4,4',4"-triisocyanate (TMT). However, other suitable cross-linking agents may also be used.

Figure 9:
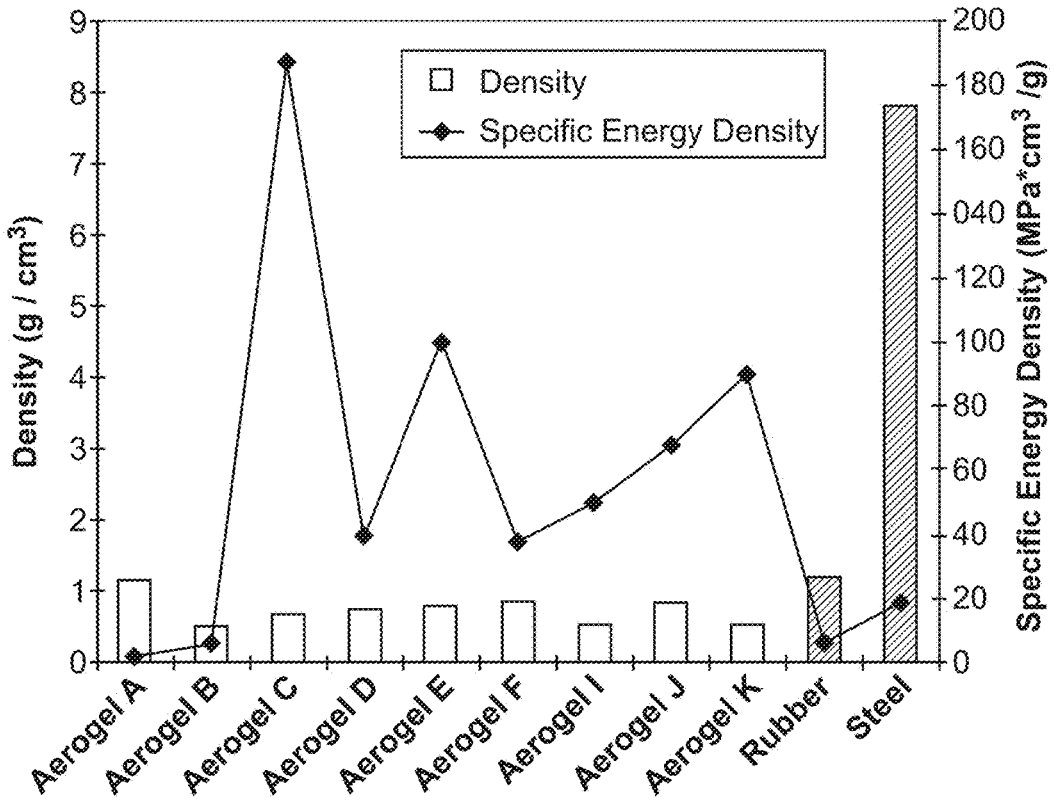
FIG. 9 is a plot showing the density and specific energy density for various aerogels as compared to rubber and steel.

FIG. 9 illustrates the relationship between density and specific energy absorbed for nine cross-linked silica aerogels of different densities as compared to rubber and steel (J. Zhong, Optimization of Crosslinked Aerogel Nanostructures for Energy Absorption, Texas Junior Academy of Science 2010, experiments performed at UTD, Professor H. Lu's lab). FIG. 9 demonstrates that the porous structure of aerogels provides for a much higher specific energy absorbed than rubber and steel, thus allowing aerogels to dissipate a larger amount of energy.

An aerogel disintegration-resistant porous material may have a density within a range having a lower limit and/or an upper limit. The range may include or exclude the lower limit and/or the upper limit. The lower limit and/or upper limit may be selected from any density. For example, the density range may be any range selected for example from 0.1 g/cm$^3$ to 1.5 g/cm$^3$, or alternatively from 0.3 g/cm$^3$ to 1.3 g/cm$^3$, or alternatively from 0.5 g/cm$^3$ to 1.3 g/cm$^3$, or any combination of the aforementioned sizes or sizes therebetween. An aerogel disintegration-resistant porous material may also have a density of from 0.5 to 1.0 g/cm$^3$, or from 0.5 to 0.8 g/cm$^3$.

At least in some cases, an optimal aerogel density for maximizing the absorption of specific energy may be around 0.68 g/cm$^3$.

A particular aerogel or disintegration-resistant porous material can be selected for a particular perforation operation that is microstructurally optimized for the loading rate and subsurface conditions anticipated upon detonation of one or more explosive devices in the perforating gun. The loading rate, as disclosed herein, refers to the change in pressure per unit time experienced by the casing, subterranean formation, and/or the gun body upon detonation of one or more explosive devices in the perforating gun.

The perforating gun apparatus can comprise at least one disintegration-resistant porous material selected from the group consisting of aerogels, cross-linked aerogels, silica aerogels, amine-modified silica aerogels, and an isocyanate cross-linked amine-modified silica aerogel.

The method of attenuating the effects of fluid inrush produced by perforating a subterranean well or wellbore including a disintegration-resistant porous material, may further include selection of an aerogel or disintegration-resistant porous material that is microstructurally optimized for the loading rate or subsurface conditions anticipated upon detonation of one or more explosive devices in the perforating gun.

The perforating gun system, disclosed herein, may further include selection of an aerogel or disintegration-resistant porous material that is microstructurally optimized for the loading rate or subsurface conditions anticipated upon detonation of one or more explosive devices in the perforating gun.

The disintegration-resistant porous material must be able to withstand an operating temperature greater than 150 degrees Celsius, in at least some cases. The disintegration-resistant porous material may, therefore, have an operating temperature within a range having a lower limit and/or an upper limit. The range may include or exclude the lower limit and/or the upper limit. The lower limit and/or upper limit may be selected from 0 to 200 degrees Celsius depending on subterranean conditions.

The disintegration-resistant porous material must be able to withstand an operating pressure of up to 30,000 psi, in some instances. The disintegration-resistant porous material may, therefore, have an operating differential pressure capability within a range having a lower limit and/or an upper limit. The range may include or exclude the lower limit and/or the upper limit, each of which may range from as low as just above zero psi to as high as 40,000 psi. For example, the disintegration-resistant porous material may have an operating differential pressure capability of from 5,000 to 30,000 psi, depending on subterranean conditions.

The disintegration-resistant porous material may also be compatible with a variety of wellbore fluids, including but not limited to hydrocarbons, salt water, fracturing fluids, gelling fluids, drilling fluids or other fluids prior, during or after fracturing and drilling operations.

Numerous examples are provided herein to enhance understanding of the present disclosure. A specific set of examples are provided as follows.

In a first example, there is disclosed a perforating gun apparatus including a gun body; at least one explosive device disposed in the gun body; and a disintegration-resistant porous material disposed in the gun body, wherein the disintegration-resistant porous material attenuates the inrush of fluid subsequent to detonation of the explosive device.

In a second example, an apparatus is disclosed according to the preceding example wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

In a third example, an apparatus is disclosed according to any of the preceding examples, wherein the disintegration-resistant porous material is positioned within the gun body proximate to an upper end portion and/or a lower end portion contained in the gun body.

In a fourth example, an apparatus is disclosed according to any of the preceding examples, wherein the perforating gun apparatus comprises at least two explosive devices disposed in the gun body, and wherein the disintegration-resistant porous material is positioned within the gun body between at least two explosive devices.

In a fifth example, an apparatus is disclosed according to any of the preceding examples, wherein the free volume within the gun body is substantially filled with the disintegration-resistant porous material.

In a sixth example, an apparatus is disclosed according to any of the preceding examples, wherein the disintegration-resistant porous material is positioned within the gun body in the form of at least one ring or baffle.

In a seventh example, an apparatus is disclosed according to any of the preceding examples, wherein the perforating gun apparatus is partially-loaded with explosive devices, and, optionally, includes disintegration-resistant porous material positioned in place of the absent explosive devices.

In an eighth example, an apparatus is disclosed according to any of the preceding examples, wherein the disintegration-resistant porous material is at least partially covered by a shroud or other protective coating.

In a ninth example, an apparatus is disclosed according to any of the preceding examples, wherein the disintegration-resistant porous material has a density of 0.5 g/cm$^3$ to 1.3 g/cm$^3$.

In a tenth example, an apparatus is disclosed according to any of the preceding examples, wherein the disintegration-resistant porous material has a density of 0.5 g/cm$^3$ to 0.8 g/cm$^3$.

In an eleventh example, an apparatus is disclosed according to any of the preceding examples, wherein the disintegration-resistant porous material is microstructurally optimized for the loading rate or subsurface conditions anticipated upon detonation of at least one explosive device.

In a twelfth example, an apparatus is disclosed according to any of the preceding examples, wherein the disintegration-resistant porous material has a density of 0.1 g/cm$^3$ to 1.5 g/cm$^3$.

In a thirteenth example, an apparatus is disclosed according to any of the preceding examples, wherein the disintegration-resistant porous material has a density of 0.3 g/cm$^3$ to 1.3 g/cm$^3$.

In a fourteenth example, an apparatus is disclosed according to any of the preceding examples, wherein the disintegration-resistant porous material has a density of 0.5 g/cm$^3$ to 1.0 g/cm$^3$.

In a fifteenth example, an apparatus is disclosed according to any of the preceding examples, wherein the disintegration-resistant porous material has a density of around 0.68 g/cm$^3$.

In a sixteenth example, an apparatus is disclosed according to any of the preceding examples, wherein the disintegration-resistant porous material may be positioned within the partially-loaded perforating gun apparatus proximate an area where the greatest magnitude pressure spike is anticipated to occur upon detonation.

In a seventeenth example, an apparatus is disclosed according to any of the preceding examples, wherein the perforating gun apparatus includes a charge holder that is at least in part constructed from disintegration-resistant porous material.

In an eighteenth example, an apparatus is disclosed according to any of the preceding examples, wherein the perforating gun apparatus includes disintegration-resistant porous material that is disposed in the gun body in the form of a cylinder.

In a nineteenth example, an apparatus is disclosed according to any of the preceding examples, wherein the perforating gun apparatus includes disintegration-resistant porous material that is disposed in the gun body in the form of pucks or discs.

In a twentieth example, an apparatus is disclosed according to any of the preceding examples, wherein the apparatus is operable in static underbalanced, dynamic underbalanced, or overbalanced wellbore conditions.

In a twenty-first example, an apparatus is disclosed according to any of the preceding examples, wherein the disintegration-resistant porous material has an operating differential pressure capability of from 5,000 to 30,000 psi.

In a twenty-second example, an apparatus is disclosed according to any of the preceding examples, wherein the apparatus does not significantly cause or enhance dynamic underbalancing.

In a twenty-third example, an apparatus is disclosed according to any of the preceding examples, wherein the disintegration-resistant porous material includes at least one selected from the group consisting of polyimide aerogels, carbide aerogels, metal aerogels, metalloid aerogels, silicon carbide aerogels, iron carbide aerogels, vanadium carbide aerogels, tin carbide aerogels, boron carbide aerogels, nickel carbide aerogels, metal oxide aerogels, iron oxide aerogels, nickel oxide aerogels, tin oxide aerogels, vanadium oxide aerogels, chalcogenide aerogels, nitride aerogels, phosphide aerogels, foamed metals, and compressed wire meshes.

In a twenty-fourth example, an apparatus is disclosed according to any of the preceding examples, wherein the cross-linking agent used to conformally coat the porous three-dimensional precursor material to form the cross-linked aerogel includes at least one selected from the group consisting of isocyanate, diisocyanate, polyisocyanate, polyimides, and triphenylmethane-4,4',4"-triisocyanate (TMT).

In a twenty-fifth example, a method is disclosed that includes running at least one perforating gun into a wellbore to a perforation depth, wherein the perforating gun comprises at least one explosive device and a disintegration-resistant porous material disposed within the body of the perforating gun; and detonating at least one explosive device disposed within the body of the at least one perforating gun, wherein the disintegration-resistant porous material is capable of attenuating effects of fluid rushing into the body of the perforating gun subsequent to detonation of the explosive device.

In a twenty-sixth example, a method is disclosed according to the twenty-fifth example, wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

In a twenty-seventh example, a method is disclosed according to the twenty-fifth or twenty-sixth examples, wherein the porous material is microstructurally optimized for the loading rate or subsurface conditions anticipated upon detonation of at least one explosive device.

In a twenty-eighth example, a method is disclosed according to the twenty-fifth to the twenty-seventh examples, wherein the method further includes placing the disintegration-resistant porous material in the perforating gun proximate an area along the length of the gun where a greatest magnitude pressure spike is anticipated to occur upon detonation.

In a twenty-ninth example, a method is disclosed according to the twenty-fifth to the twenty-eighth examples, wherein the perforation gun is partially-loaded with explosive devices.

In a thirtieth example, a method is disclosed according to any of the preceding examples, wherein the disintegration-resistant porous material is positioned within the gun body proximate to an upper end portion and/or a lower end portion contained in the gun body.

In a thirty-first example, a method is disclosed according to any of the preceding examples, wherein the perforating gun comprises at least two explosive devices disposed in the gun body, and wherein the disintegration-resistant porous material is positioned within the gun body between at least two explosive devices.

In a thirty-second example, a method is disclosed according to any of the preceding examples, wherein the free volume within the gun body is substantially filled with the disintegration-resistant porous material.

In a thirty-third example, a method is disclosed according to any of the preceding examples, wherein the disintegration-resistant porous material is positioned within the gun body in the form of at least one ring or baffle.

In a thirty-fourth example, a method is disclosed according to any of the preceding examples, wherein the perforating gun apparatus is partially-loaded with explosive devices, and, optionally, the disintegration-resistant porous material is positioned in place of the absent explosive devices.

In a thirty-fifth example, a method is disclosed according to any of the preceding examples, wherein the disintegration-resistant porous material is at least partially covered by a shroud or other protective coating.

In a thirty-sixth example, a method is disclosed according to any of the preceding examples, wherein the disintegration-resistant porous material has a density of 0.5 g/cm$^3$ to 1.3 g/cm$^3$.

In a thirty-seventh example, a method is disclosed according to any of the preceding examples, wherein the disintegration-resistant porous material has a density of 0.5 g/cm$^3$ to 0.8 g/cm$^3$.

In a thirty-eighth example, a method is disclosed according to any of the preceding examples, wherein the disintegration-resistant porous material has a density of 0.1 g/cm$^3$ to 1.5 g/cm$^3$.

In a thirty-ninth example, a method is disclosed according to any of the preceding examples, wherein the disintegration-resistant porous material has a density of 0.3 g/cm$^3$ to 1.3 g/cm$^3$.

In a fortieth example, a method is disclosed according to any of the preceding examples, wherein the disintegration-resistant porous material has a density of 0.5 g/cm$^3$ to 1.0 g/cm$^3$.

In a forty-first example, a method is disclosed according to any of the preceding examples, wherein the disintegration-resistant porous material has a density of around 0.68 g/cm$^3$.

In a forty-second example, a method is disclosed according to any of the preceding examples, wherein the perforating gun includes a charge holder that is at least in part constructed from disintegration-resistant porous material.

In a forty-third example, a method is disclosed according to any of the preceding examples, wherein the perforating gun apparatus includes disintegration-resistant porous material that is disposed in the gun body in the form of a cylinder.

In a forty-fourth example, a method is disclosed according to any of the preceding examples, wherein the perforating gun apparatus includes disintegration-resistant porous material that is disposed in the gun body in the form of pucks or discs.

In a forty-fifth example, a method is disclosed according to any of the preceding examples, wherein the method is operable in static underbalanced, dynamic underbalanced, or overbalanced wellbore conditions.

In a forty-sixth example, a method is disclosed according to any of the preceding examples, wherein the disintegration-resistant porous material includes one selected from the group consisting of foamed metals and compressed wire meshes.

In a forty-seventh example, a method is disclosed according to any of the preceding examples, wherein the method does not significantly cause or enhance dynamic underbalancing.

In a forty-eighth example, a method is disclosed according to any of the preceding examples, wherein the disintegration-resistant porous material includes at least one selected from the group consisting of polyimide aerogels, carbide aerogels, metal aerogels, metalloid aerogels, silicon carbide aerogels, iron carbide aerogels, vanadium carbide aerogels, tin carbide aerogels, boron carbide aerogels, nickel carbide aerogels, metal oxide aerogels, iron oxide aerogels, nickel oxide aerogels, tin oxide aerogels, vanadium oxide aerogels, chalcogenide aerogels, nitride aerogels, phosphide aerogels, foamed metals, and compressed wire meshes.

In a forty-ninth example, a method is disclosed according to any of the preceding examples, wherein the cross-linking agent used to conformally coat the porous three-dimensional precursor material to form the cross-linked aerogel includes at least one selected from the group consisting of isocyanate, diisocyanate, polyisocyanate, polyimides, and triphenylmethane-4,4',4"-triisocyanate (TMT).

In a fiftieth example, a perforating gun system is disclosed that includes at least one explosive device disposed within a gun body; and a disintegration-resistant porous material disposed in the gun body, wherein the disintegration-resistant porous material attenuates a rush of fluid into the gun body subsequent to detonation of the explosive device.

In a fifty-first example, a system is disclosed according to the fiftieth example, wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

In a fifty-second example, a system is disclosed according to the fiftieth or fifty-first examples, wherein the disintegration-resistant porous material is microstructurally optimized for the loading rate and subsurface conditions anticipated upon detonation of the at least one explosive device.

In a fifty-third example, a system is disclosed according to the fiftieth to the fifty-second examples, wherein the disintegration-resistant porous material is positioned in the gun body proximate an area along the length of the gun where a greatest magnitude pressure spike is anticipated to occur upon detonation.

In a fifty-fourth example, a system is disclosed according to the fiftieth to the fifty-third examples, wherein the gun body is partially-loaded with explosive devices, and, optionally, the disintegration-resistant porous material is positioned in place of the absent explosive devices.

In a fifty-fifth example, a system is disclosed according to the fiftieth to the fifty-fourth examples, wherein the disintegration-resistant porous material includes one selected from the group consisting of foamed metals and compressed wire meshes.

In a fifty-sixth example, a system is disclosed according to any of the preceding examples, wherein the disintegration-resistant porous material is positioned within the gun body proximate to a upper end portion and/or a lower end portion contained in the gun body.

In a fifty-seventh example, a system is disclosed according to any of the preceding examples, wherein the perforating gun includes at least two explosive devices disposed in the gun body, and wherein disintegration-resistant porous material is positioned within the gun body between at least two explosive devices.

In a fifty-eighth example, a system is disclosed according to any of the preceding examples, wherein the free volume within the gun body is substantially filled with the disintegration-resistant porous material.

In a fifty-ninth example, a system is disclosed according to any of the preceding examples, wherein the disintegration-resistant porous material is positioned within the gun body in the form of at least one ring or baffle.

In a sixtieth example, a system is disclosed according to any of the preceding examples, wherein the perforating gun apparatus is partially-loaded with explosive devices.

In a sixty-first example, a system is disclosed according to any of the preceding examples, wherein the disintegration-resistant porous material is at least partially covered by a shroud or other protective coating.

In a sixty-second example, a system is disclosed according to any of the preceding examples, wherein the disintegration-resistant porous material has a density of 0.5 g/cm$^3$ to 1.3 g/cm$^3$.

In a sixty-third example, a system is disclosed according to any of the preceding examples, wherein the disintegration-resistant porous material has a density of 0.5 g/cm$^3$ to 0.8 g/cm$^3$.

In a sixty-fourth example, a system is disclosed according to any of the preceding examples, wherein the disintegration-resistant porous material has a density of 0.1 g/cm$^3$ to 1.5 g/cm$^3$.

In a sixty-fifth example, a system is disclosed according to any of the preceding examples, wherein the disintegration-resistant porous material has a density of 0.3 g/cm$^3$ to 1.3 g/cm$^3$.

In a sixty-sixth example, a system is disclosed according to any of the preceding examples, wherein the disintegration-resistant porous material has a density of 0.5 g/cm$^3$ to 1.0 g/cm$^3$.

In a sixty-seventh example, a system is disclosed according to any of the preceding examples, wherein the disintegration-resistant porous material has a density of around 0.68 g/cm$^3$.

In a sixty-eighth example, a system is disclosed according to any of the preceding examples, wherein the perforating gun system includes a charge holder that is at least in part constructed from disintegration-resistant porous material.

In a sixty-ninth example, a system is disclosed according to any of the preceding examples, wherein the perforating gun system includes disintegration-resistant porous material that is disposed in the gun body in the form of a cylinder.

In a seventieth example, a system is disclosed according to any of the preceding examples, wherein the perforating gun system includes disintegration-resistant porous material that is disposed in the gun body in the form of pucks or discs.

In a seventy-first example, a system is disclosed according to any of the preceding examples, wherein the system is operable in static underbalanced, dynamic underbalanced, or overbalanced wellbore conditions.

In a seventy-second example, a system is disclosed according to any of the preceding examples, wherein the system does not significantly cause or enhance dynamic underbalancing.

In a seventy-third example, a system is disclosed according to any of the preceding examples, wherein the disintegration-resistant porous material includes at least one selected from the group consisting of polyimide aerogels, carbide aerogels, metal aerogels, metalloid aerogels, silicon carbide aerogels, iron carbide aerogels, vanadium carbide aerogels, tin carbide aerogels, boron carbide aerogels, nickel carbide aerogels, metal oxide aerogels, iron oxide aerogels, nickel oxide aerogels, tin oxide aerogels, vanadium oxide aerogels, chalcogenide aerogels, nitride aerogels, phosphide aerogels, foamed metals, and compressed wire meshes.

In a seventy-fourth example, a system is disclosed according to any of the preceding examples, wherein the cross-linking agent used to conformally coat the porous three-dimensional precursor material to form the cross-linked aerogel includes at least one selected from the group consisting of isocyanate, diisocyanate, polyisocyanate, polyimides, and triphenylmethane-4,4',4"-triisocyanate (TMT).

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

What is claimed is:

1. A perforating gun apparatus comprising:

a gun body;

at least one explosive device disposed in the gun body that when activated pierces through the gun body; and a disintegration-resistant porous material disposed in the gun body in the form of a ring, a disc, a puck, or a baffle in a position determined to have a greatest magnitude pressure spike in the gun body, wherein the disintegration-resistant porous material attenuates the inrush of fluid subsequent to detonation of the explosive device;

wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

2. The perforating gun apparatus according to claim 1, wherein the disintegration-resistant porous material is positioned within the gun body proximate to an upper end portion or a lower end portion contained in the gun body.

3. The perforating gun apparatus according to claim 1, wherein the perforating gun apparatus comprises at least two explosive devices disposed in the gun body, and wherein the disintegration-resistant porous material is positioned within the gun body between the at least two explosive devices.

4. The perforating gun apparatus according to claim 1, wherein the disintegration-resistant porous material is positioned within the gun body in the form of at least one ring or baffle.

5. The perforating gun apparatus according to claim 1, wherein the perforating gun apparatus is partially-loaded with explosive devices.

6. The perforating gun apparatus according to claim 1, wherein the disintegration-resistant porous material is at least partially covered by a shroud or other protective covering.

7. The perforating gun apparatus according to claim 1, wherein the disintegration-resistant porous material has a density of 0.5 g/cm$^3$ to 1.3 g/cm$^3$.

8. The perforating gun apparatus according to claim 1, wherein the disintegration-resistant porous material has a density of 0.5 g/cm$^3$ to 0.8 g/cm$^3$.

9. A method, comprising:

running at least one perforating gun into a wellbore to a perforation depth, wherein the perforating gun comprises at least one explosive device and a disintegration-resistant porous material disposed within the body of the perforating gun; and detonating the at least one explosive device disposed in the body of the at least one perforating gun such that when the at least one explosive device is detonated, the at least one explosive device pierces through the body of the at least one perforating gun, wherein the disintegration-resistant porous material is in the form of a ring, a disc, a puck, or a baffle in a position determined to have a greatest magnitude pressure spike in the gun body and capable of attenuating effects of fluid rushing into the body of the perforating gun subsequent to detonation of the explosive device, wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

10. The method according to claim 9, wherein the porous material is microstructurally optimized for the loading rate or subsurface conditions anticipated upon detonation of the at least one explosive device.

11. The method according to claim 9, further comprising placing the disintegration-resistant porous material in the at least one perforating gun proximate an area along the length of the gun where a greatest magnitude pressure spike is anticipated to occur upon detonation.

12. The method according to claim 9, wherein the perforating gun is partially-loaded with explosive devices.

13. A perforating gun system comprising:

at least one explosive device disposed in a gun body that when activated pierces through the gun body: and a disintegration-resistant porous material disposed in the gun body in the form of a ring, a disc, a puck, or a baffle, wherein the disintegration-resistant porous material is in a position determined to have a greatest magnitude pressure spike in the gun body and attenuates a rush of fluid into the gun body subsequent to detonation of the explosive device;

wherein the disintegration-resistant porous material comprises at least one selected from the group consisting of aerogels, cross-linked aerogels, silica aerogels, amine-modified silica aerogels, isocyanate cross-linked amine-modified silica aerogels, foamed metals, and compressed wire meshes.

14. The system according to claim 13, wherein the disintegration-resistant porous material is microstructurally optimized for the loading rate and subsurface conditions anticipated upon detonation of the at least one explosive device.

15. The system according to claim 13, wherein the disintegration-resistant porous material is positioned in the gun body proximate an area along the length of the gun where the greatest magnitude pressure spike is anticipated to occur upon detonation.

16. The system according to claim 13, wherein the gun body is partially-loaded with explosive devices.

17. A method, comprising:

running at least one perforating gun into a wellbore to a perforation depth, wherein the perforating gun comprises at least one explosive device and a disintegration-resistant porous material disposed within the gun body of the at least one perforating gun; and detonating the at least one explosive device of the at least one perforating gun such that when the at least one explosive device is detonated, the at least one explosive device pierces through the gun body, wherein the disintegration-resistant porous material is positioned within the gun body in the form of a ring, a disc, a puck, or a baffle in a position determined to have a greatest magnitude pressure spike in the gun body near the upper end portion or lower end portion of the gun body in order to attenuate a pressure spike associated with fluid acceleration towards the terminal portions of the body.

* * * * *